US008146199B2

(12) United States Patent
Yoo et al.

(10) Patent No.: US 8,146,199 B2
(45) Date of Patent: Apr. 3, 2012

(54) VACUUM CLEANER

(75) Inventors: Myung Keun Yoo, Seoul (KR); Sang Young Kim, Gyeonggi-do (KR); Kwang Woon Ahn, Seoul (KR); Hyoun Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 999 days.

(21) Appl. No.: 11/866,105

(22) Filed: Oct. 2, 2007

(65) Prior Publication Data

US 2008/0295275 A1 Dec. 4, 2008

(30) Foreign Application Priority Data

Jun. 1, 2007 (KR) ..... 10-2007-0053951

(51) Int. Cl.
*A47L 9/28* (2006.01)

(52) U.S. Cl. ..... 15/327.2; 15/DIG. 1; 15/DIG. 10

(58) Field of Classification Search ..... 15/327.2, 15/DIG. 1, DIG. 10; *A47L 9/26, 9/28*
See application file for complete search history.

(56) References Cited

U.S. PATENT DOCUMENTS

| | | | | |
|---|---|---|---|---|
| 2001/0029641 | A1 * | 10/2001 | Uratani et al. | 15/327.4 |
| 2005/0262660 | A1 | 12/2005 | Yoo et al. | |
| 2009/0113664 | A1 * | 5/2009 | Moore et al. | 15/347 |

FOREIGN PATENT DOCUMENTS

| | | | |
|---|---|---|---|
| JP | 405168579 | * | 7/1993 |
| JP | 05-192270 | | 8/1993 |
| KR | 10-2001-0018141 | A | 3/2001 |
| KR | 10-2002-0026970 | A | 4/2002 |

OTHER PUBLICATIONS

U.S. Appl. No. 11/866,670 to Yoo et al., filed Oct. 3, 2007.
U.S. Appl. No. 11/866,750 to Kim et al, filed Oct. 3, 2007.

* cited by examiner

*Primary Examiner* — David Redding
(74) *Attorney, Agent, or Firm* — McKenna Long & Aldridge LLP

(57) ABSTRACT

A vacuum cleaner set includes a vacuum cleaner and a cleaner mount. The vacuum cleaner includes a main body that is detachably mounted on a mount having a cord reel, a motor and a battery that are provided in the main body, an AC power source that is provided in the main body and connected to a power outlet by the cord reel, a charging device receiving power from the AC power source and charging the battery, and a control unit selecting one of power output from the battery and power output from the AC power source.

8 Claims, 3 Drawing Sheets

VACUUM CLEANER

CROSS REFERENCE TO RELATED APPLICATION

The present disclosure relates to subject matter contained in priority Korean Patent Application No. 2007-0053951, filed on Jun. 1, 2007, which is herein expressly incorporated by reference in its entirety.

BACKGROUND OF THE INVENTION

1. Field of the Invention

The present disclosure relates to a vacuum cleaner. More particularly, the present disclosure relates to a vacuum cleaner that has a battery charging device and a rechargeable battery and thus use both an alternating current (AC) power and a direct current (DC) power.

2. Description of Related Art

Generally, a vacuum cleaner is designed to withdraw dust by driving a motor using electric power applied from an external power source through a power cord mounted on a main body.

When the vacuum cleaner is configured to operate by AC power supplied from the external power source to a building, a cleaning space may be limited due to a limited length of the power cord wound around a cord reel installed in the main body.

Recently, a cordless vacuum cleaner that is configured to operate by a battery without depending on external electric power has been developed. Further, a vacuum cleaner that can operate by either electric power applied from the external power source through the power cord or the rechargeable battery has been developed.

Meanwhile, when the vacuum cleaner is designed to operate by household power, an AC induction motor is mainly used. However, since a vacuum cleaner having a rechargeable battery and a recharging device has recently been used, a motor using both of the AC and DC powers has been widely used.

In the vacuum cleaner having an AC/DC induction motor, when the AC power is cut off, a voltage or current applied to the motor is adjusted by manipulating a switch provided on the vacuum cleaner to use the DC power of the battery provided in the vacuum cleaner.

In the cordless vacuum cleaner having the rechargeable battery storing the DC power, since the electric power is applied from the rechargeable battery and thus no cord is required, the cleaning space can be enlarged locations far from a socket outlet. However, since the capacity of the battery is small, the battery must be recharged while the vacuum cleaner is not used.

SUMMARY OF THE INVENTION

The present invention is provided to address the above described problems. Embodiments of the present invention provide a vacuum cleaner set that can perform an AC/DC conversion by simply inserting and removing a power or connection cord from a vacuum cleaner and can easily charge a battery installed in the vacuum cleaner even in the course of using the vacuum cleaner.

Embodiments of the present invention also provide a vacuum cleaner that has a main body and a cord reel that are separated, thereby reducing the size and weight of the vacuum cleaner, and further has a battery that is provided near a weight center of the vacuum cleaner to provide a stable structure.

Embodiments of the present invention also provide a cleaner mount that can provide a stable floor support and has a cord reel arrangement extending in a horizontal direction with respect to a mounting portion on which the vacuum cleaner is supported vertically.

An aspect of the present invention provides a vacuum cleaner including a main body not having a cord reel; and a coupling surface that is formed on the main body to detachably support a mount having a cord reel. Further, the main body may include a charging device and a battery. In a further aspect of the present invention, the battery is provided at a center or weight center of the main body. The main body may further include a switched reluctance motor that automatically starts and stops in accordance with whether electric power is applied or not. The main body may include an inverter for performing an AC/DC conversion or a DC/AC conversion; the main body may include a control unit that selects a DC power input from the battery or an AC power input from the cord reel. Further, the control unit may include a power detecting circuit that detects if the input power is the AC or DC power using a voltage difference between the AC power and the DC power.

A vacuum cleaner set of the present invention includes two parts: a vacuum cleaner and a cleaner mount.

In an aspect of the present invention, the vacuum cleaner may include a main body that is detachably mounted on a mount having a cord reel; a motor and a battery that are provided in the main body; an AC power source that is provided in the main body and connected to a power outlet by the cord reel; a charging device receiving power from the AC power source and charging the battery; and a control unit selecting one of power output from the battery and power output from the AC power source.

The AC power source may include a power distributing structure for distributing the power to the control unit and the charging device. Therefore, extra power that is remained after the power is used to drive the motor can be supplied to the charging device.

The control unit may include a power detecting circuit that detects if the input power is the AC or DC power using a voltage difference between the AC power and the DC power.

The main body may include an inverter for selecting one of AC power and DC power. The motor may be a switched reluctance motor that automatically starts and stops in accordance with whether electric power is applied or not.

The battery functions to supply electric power (DC power) to the motor in a state where the motor is supplied with the power (AC power) from the AC power source. In this case, the battery may be provided at a center or weight center of the main body to prevent a weight center imbalance of the main body.

With the vacuum cleaner of the above-described embodiment, the AC/DC power conversion can be realized by simply taking out the power cord from the power outlet without using any mechanical switch. Likewise, the DC/AC power conversion can be realized by simply taking the power cord in the power outlet without using any mechanical switch.

The battery can be continuously charged even when the vacuum cleaner operates with the AC power.

In another embodiment of the present invention, the cleaner mount includes: a cord reel; a power cord that winds in and out in a first direction of the cord reel and is connected to an external power source; a connection cord that winds in and out in a second direction of the cord reel and is connected to a main body of a vacuum cleaner; a mounting portion that is configured to detachably support the main body of the vacuum cleaner; and a case that houses the cord reel and supports the mounting portion.

The mounting portion may be formed in a shape corresponding to a coupling surface of the main body and configured to enclose the coupling surface of the main body so as to support the main body that is erected.

The power cord and the connection cord wind in and out in a direction parallel with a bottom surface of the case so as to prevent the mount from falling down or being turned over during the movement of the main body.

In this embodiment, the case may have a frictional portion that is formed on a bottom surface to resist against tension of the connection cord and/or the power cord.

The power cord and/or the connection cord may wind in and out step by step so that the user can conveniently select a location where the mount is located during the cleaning work.

As described above, the vacuum cleaner set is formed with a combination of the vacuum cleaner and the cleaner mount. When the vacuum cleaner operates with the AC power, the battery can be continuously charged. When the vacuum cleaner does not operate, the main body of the vacuum cleaner can be snugly fixed on the cleaner mount.

When the user intends to clean a place where the cord cannot reach, the connection cord is separated from the main body so that the user can use the vacuum cleaner with the DC power output from the battery installed in the main body. Therefore, convenience of use of the cleaning device can be improved.

The details of the embodiments are set forth in the accompanying drawings and the description below. Other features will be apparent from the description and drawings, and from the claims.

BRIEF DESCRIPTION OF THE DRAWINGS

The above, and other objects, features, and advantages of the present invention will be made apparent from the following description of the preferred embodiments, given as non-limiting examples, with reference to the accompanying drawings in which.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts. The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
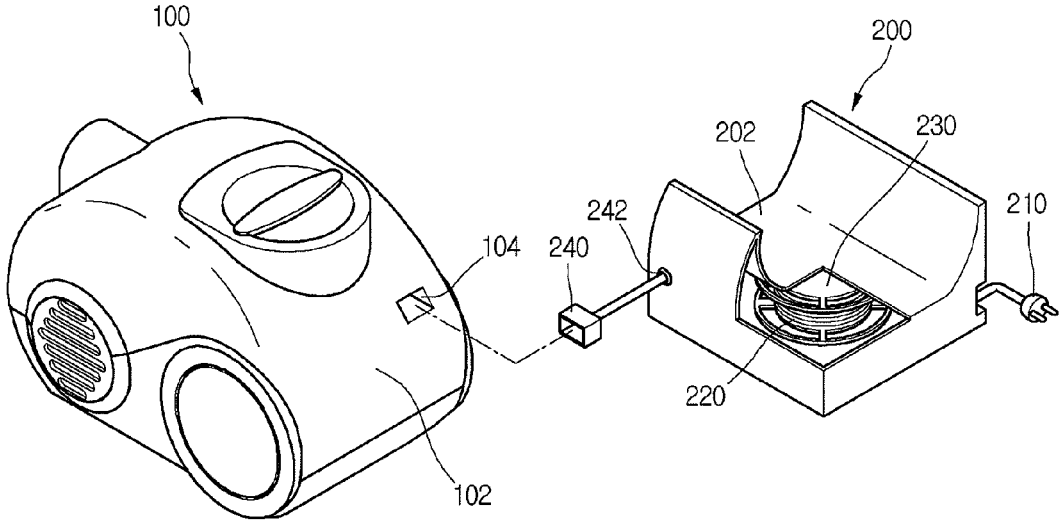
FIG. 1 is a perspective view of a vacuum cleaner according to an embodiment of the present invention.

FIG. 1 is a perspective view of a vacuum cleaner according to an embodiment of the present invention.

Referring to FIG. 1, a vacuum cleaner of an embodiment of the present invention includes a main body 100 defining an outer appearance of the vacuum cleaner and a cleaner mount 200 having a connection cord 240 connected to the main body 100, a power cord 210, a cord reel 230 around which the connection and power cords 240 and 210 are wound, a case 220 housing the cord reel 230, and a mounting portion 202 formed on a top surface of the case 220.

The main body 100 has a mounting surface 102 that is formed in a shape corresponding to the mounting portion 202 formed on the case so that the main body 100 can snugly seat on the mounting portion 202 of the cleaner mount 200.

In addition, the main body 100 is provided with a connection cord insertion hole 104 in which the connection cord 240 is inserted. The connection cord insertion hole 104 functions as a passage along which the connection cord 240 supplies AC power.

The connection cord 240 is a connection terminal connecting the main body 100 to a power outlet (not shown). By connecting the connection cord 240 to the main body 100, the main body 100 is driven using the AC power. By disconnecting the connection cord 240 with the main body 100, the main body 100 may be driven using DC power.

The cord reel 230 is installed in the lower case 220 of the cleaner mount 220. The cord reel 230 is constructed to have rotational elasticity so that the connection cord can be automatically wound there around. A first end portion of the cord wound around the cord reel 230 is the connection cord 240 that is connected to the main body 100. A second end portion of the cord wound around the cord reel 230 is the power cord that is connected to the power outlet. The connection cord 240 extends through a connection cord hole 240. The connection cord hole 240 has a diameter less than a diameter of a connector portion formed at an extreme end of the connection cord 240 so that the connection portion cannot be inserted into the lower case 220.

The cleaner mount 200 having the cord reel 230 is separated from the main body 100 and thus a weight of the main body 100 can be minimized. In addition, the separation of the cleaner mount 200 from the main body allows a user to effectively perform the cleaning work without being interfered with the cord.

The connection cord or the power cord can extend from the cord reel 230 step by step. This reduces the entangling phenomenon of the cords during the cleaning work.

Figure 2:
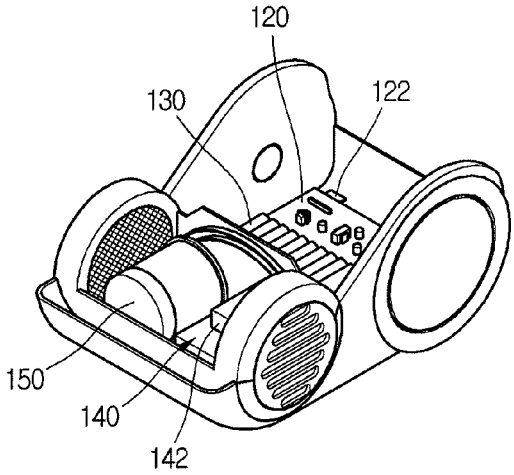
FIG. 2 is a schematic perspective view of an internal structure of the vacuum cleaner of FIG. 1.

FIG. 2 is a schematic perspective view of an internal structure of the vacuum cleaner.

Referring to FIG. 2, provided in the main body 100 are an AC power source 122 for supplying AC power from an external power source to a control unit or a charging device, a charging device 120 receiving the power from the AC power source 122, a battery for storing DC power charged by the charging device 120, a control unit 140 identifying the AC power or the DC power and driving the main body in accordance with the identified power, and a motor 150 that is driven in accordance with an AC or DC power driving command from the control unit 140.

The AC power source 122 has a power distributing structure that supplies the electric power to the control unit and, at the same time, supplies the charging power to the charging device. The power distributing structure is realized by properly arranging diodes and thus configured to rectify an AC current into a DC current in a state where it is connected to the AC power source and supply the rectified DC current to the charging device 120.

The power distributing structure supplies power, which remains after the AC power input through the AC power source 122 is used for driving the motor of the vacuum cleaner, to the charging device.

The charging device 120 is provided at a rear portion of the main body 100 and connected to the AC power source 122 connected to the connection cord 240 to charge the battery with DC power using the AC power supplied from the AC power source 122.

The battery 130 stores the DC power charged from the charging device 120. When the connection cord 240 is disconnected with the AC power source 122, the battery 130 drives the main body 100 by supplying the DC power. The battery 130 is provided near a weight center (i.e., a center of the main body) in order to maintain a weight balance of the main body 100.

The battery 130 is charged with the DC power by the charging device 120 even in the course of the main body 100 is driven by the AC power.

The control unit 140 allows the motor 150 to be driven by the AC power when the connection cord 240 is connected to the AC power source 122. When the connection cord 240 is disconnected with the AC power source 122, the control unit 140 allows the motor to be driven by the DC power.

In more detail, the control unit 140 has a power detecting circuit 142 for detecting if the power applied is the AC power or DC power. The power detecting circuit 142 detects if the power applied to the control unit 140 is the AC power or DC power. The control unit receiving the detecting signal from the power detecting circuit 142 transmits a control signal to the motor 150 that is automatically converted in accordance with a level difference between the AC power and the DC power.

The suction motor 150 has an inverter for selecting the AC power or DC power in accordance with the control signal transmitted from the control unit 140. The suction motor 150 may be a switched reluctance motor that automatically starts or stops in accordance with whether the power is applied from the AC power source or the battery.

In a state where the suction motor 150 cannot be applied with the power (AC power) from the AC power source, the battery supplies the DC power to the suction motor 150. At this point, the battery is mounted near the weight center (i.e., center portion) of the main body to prevent weight center unbalance of the main body, which may be caused by the weight of the battery.

With the above-described vacuum cleaner, the user can change the power from the AC power to the DC power or from the DC power to the AC power by simply taking the power cord in and out the power outlet. For example, in the course of using the vacuum cleaner with the DC power, the user can convert the power to the AC power by simply taking the power cord out from the power outlet.

Figure 3:
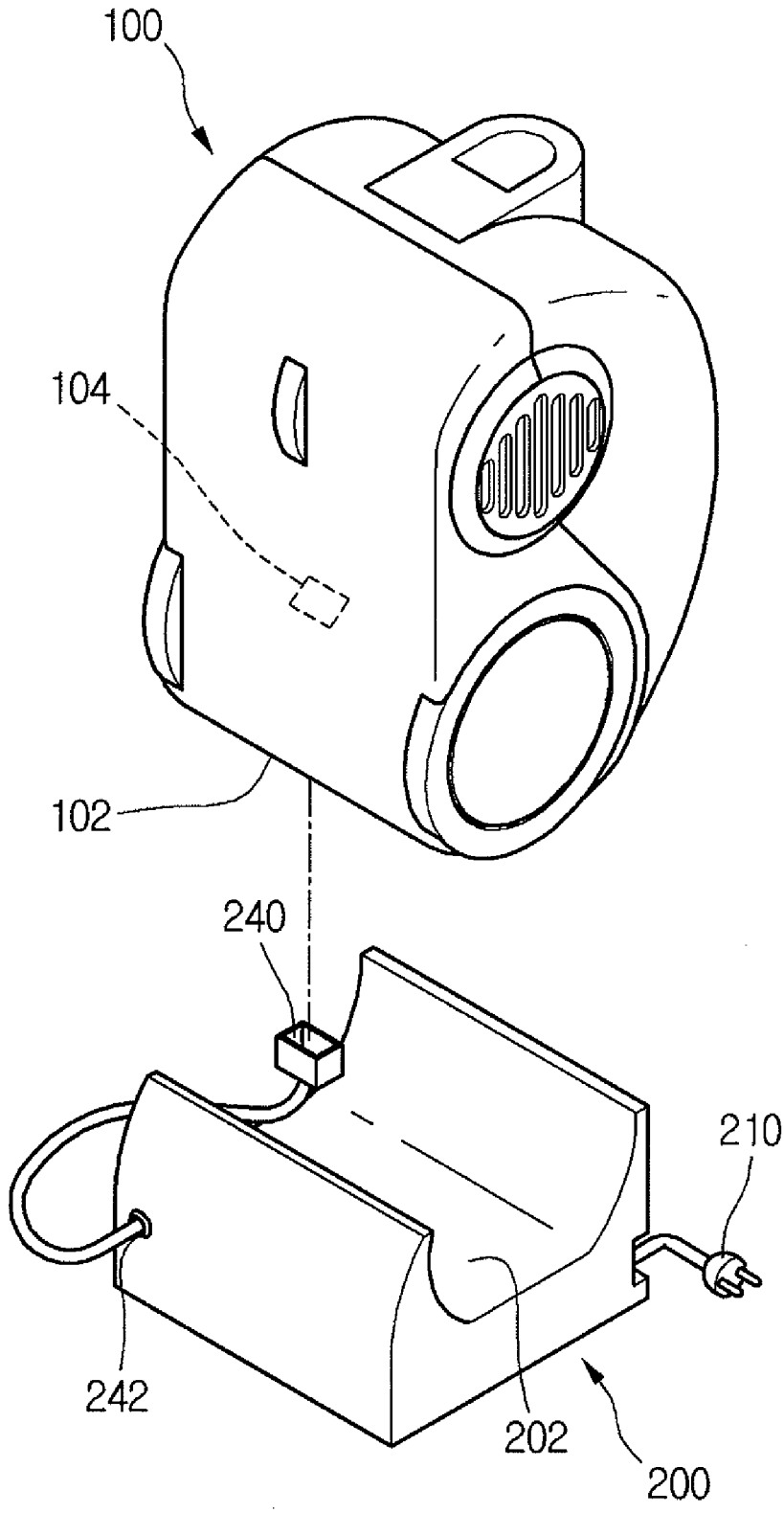
FIG. 3 is a schematic view illustrating a state where a main body of the vacuum cleaner of FIG. 1 is mounted on a cleaner mount of the vacuum cleaner.
Figure 4:
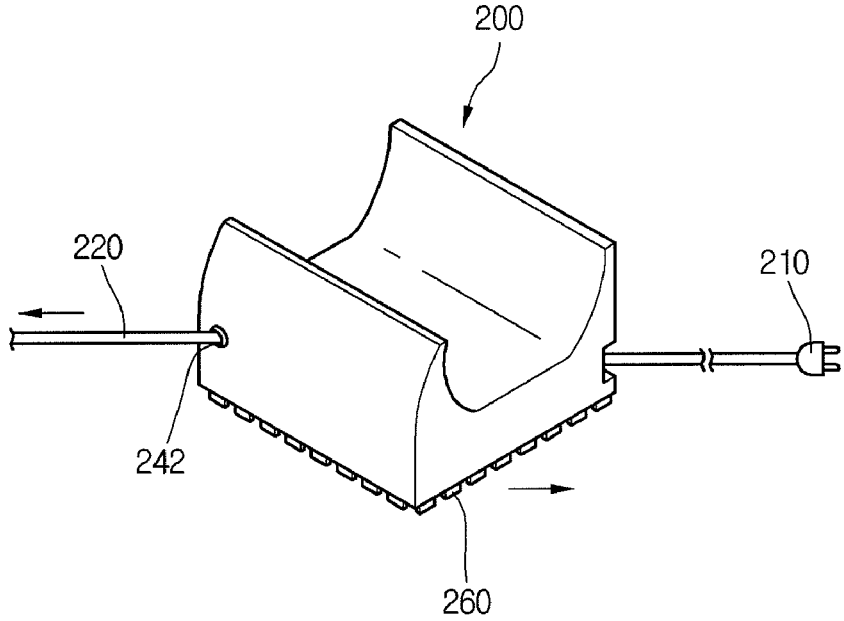
FIG. 4 is a schematic view illustrating a state where a cleaner mount of the vacuum cleaner of FIG. 1 contacts a floor.

FIG. 3 is a schematic view illustrating a state where the main body of the vacuum cleaner is being mounted on the cleaner mount of the vacuum cleaner according to an embodiment of the present invention, and FIG. 4 is a schematic view illustrating a state where the cleaner mount of the vacuum cleaner contacts a floor according to an embodiment of the present invention.

Referring to FIG. 3, the main body 100 is mounted on the cleaner mount 200. The mounting portion 202 defined on the top surface of the cleaner mount 200 is shaped to correspond to the coupling surface 102 of the main body 100.

Accordingly, the coupling surface 102 of the main body 100 can snugly seat on the mounting portion 202 of the cleaner mount 200.

The connection cord 240 extends from the connection cord hole 242 formed on the front and side surface of the cleaner mount 200.

Meanwhile, the connection cord and the power cord wind in and out in a direction parallel with the floor on which the cleaner mount 200 is disposed. Accordingly, since the extending direction of the connection and power cords coincides with a direction where a tension is applied to the cleaner mount as the cleaner main body moves, no rotational moment is applied to the cleaner mount.

Accordingly, the cleaner mount is not turned over even when the main body moves. Further, the tangling of the cords can be prevented.

Needless to say, the connection cord is inserted in the main body in a direction parallel with a bottom surface of the main body so that the connection cord 240 can wind out from the cleaner mount in a direction parallel with a bottom surface of the mount.

Therefore, as shown in the drawings, when the main body 100 is erected and coupled to the cleaner mount 200, the connection cord 240 may be separated from the main body. On the other hand, the main body 100 may be erected on the cleaner mount 200 in a state where the connection cord is inserted in the main body 100. In order to realize this, a space for connecting the connection cord to the connection cord terminal 104 should be formed between the mount portion 202 and the coupling surface 102 of the main body.

Needless to say, when the connection cord terminal 104 is not located on the coupling surface 102 of the main body, the space may not be required.

When the main body 100 is erected on the cleaner mount 200 in a state where the connection cord 240 is connected to the connection cord terminal 104, the battery can be charged.

Referring to FIG. 4, a frictional member 260 may be attached on the bottom surface of the cleaner mount 200 to increase the frictional force with the floor. The frictional member 260 may be formed of rubber in a circular or rectangular shape. The frictional member 260 contacts the floor.

When the frictional member 260 closely contacts the floor, the movement of the main body 100 can be minimized as the frictional force is applied to the cleaner mount 200 in an opposite direction to a direction in which the cords extend the cleaner mount 200 when the main body 100 moves.

Figure 5:
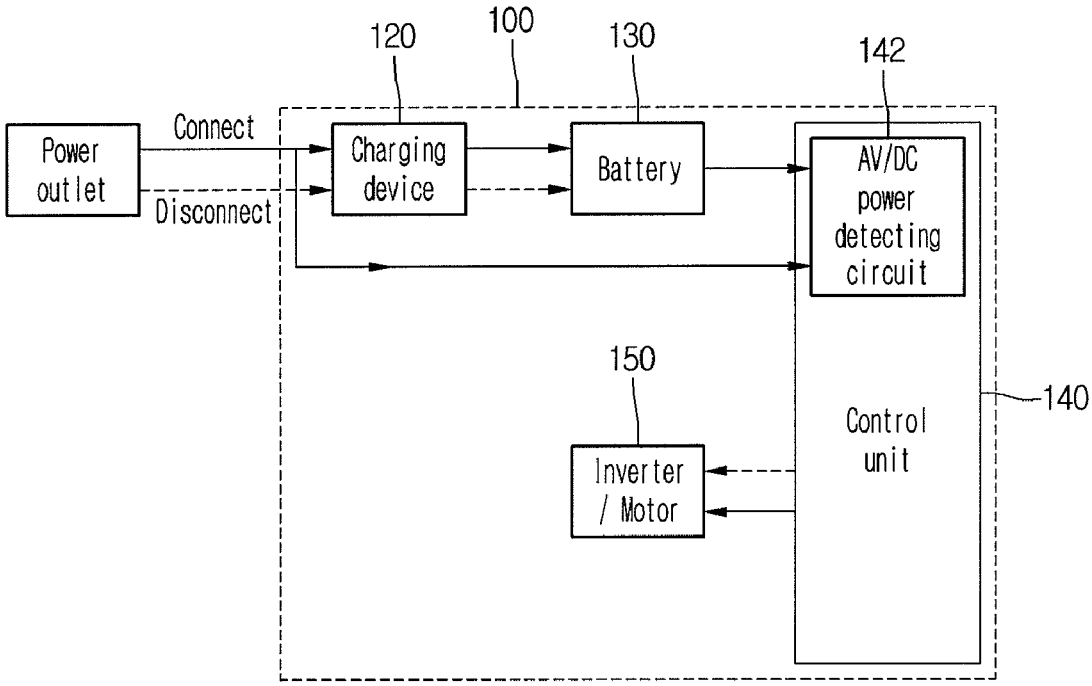
FIG. 5 is a control block diagram of the vacuum cleaner of FIG. 1.

FIG. 5 is a control block diagram of the vacuum cleaner according to an embodiment of the present invention.

Referring to FIG. 5, when the main body 100 is connected to the power outlet, the DC power is charged in the battery 130 by the charging device 120 and, at the same time, the power detecting circuit 142 detects if the power is the DC or AC power.

When it is detected that the power is the AC power, the control unit 140 transmits the driving signal to the motor 150 so that the vacuum cleaner is driven with the AC power. At this point, the motor 150 is automatically converted in an AC power driving mode by the inverter 150.

When the main body 100 is disconnected with the power outlet, the vacuum cleaner is driven with the DC power stored in the battery 130. The power detecting circuit 142 detects this and transmits the corresponding driving signal to the motor 150 so that the vacuum cleaner is driven with the DC power. At this point, the motor 150 is automatically converted in a DC power driving mode by the inverter 150.

According to the present invention, when the vacuum cleaner operates with the AC power, the battery can be continuously charged. When the vacuum cleaner does not operate, the main body of the vacuum cleaner can be snugly fixed on the cleaner mount.

Further, when the user intends to clean a place where the external power cannot be used, the connection cord is separated from the main body so that the user can use the vacuum cleaner with the DC power output from the battery installed in the main body. Therefore, the cleaning convenience can be improved.

In addition, since the AC/DC power conversion can be realized without using any mechanical switch, the user can operate the vacuum cleaner with the AC power in the course of performing the cleaning work with the DC power.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A vacuum cleaner set comprising:

a vacuum cleaner comprising:

a main body having a motor and not having a cord reel; and a coupling surface that is formed on the main body to detachably support a mount having the cord reel; and a cleaner mount comprising:

a cord reel that selectively connects to the vacuum cleaner;

a connection cord connected to the main body of the vacuum cleaner; and a mounting portion formed on an upper surface of the cleaner mount, wherein the mounting portion comprises a rounded surface and is formed in a shape corresponding to the coupling surface of the main body and supports the main body, and wherein the main body is seated on the rounded surface and is erected on the cleaner mount in a state where the connection cord is connected to the main body.

2. The vacuum cleaner set according to claim 1, wherein the main body includes a charging device and a battery.

3. The vacuum cleaner set according to claim 2, wherein the battery is provided at a center or weight center of the main body.

4. The vacuum cleaner set according to claim 1, wherein the motor is a switched reluctance motor that automatically starts and stops in accordance with whether electric power is applied or not.

5. The vacuum cleaner set according to claim 1, wherein the main body includes an inverter for performing an AC/DC conversion or a DC/AC conversion.

6. The vacuum cleaner set according to claim 1, wherein the main body includes a control unit that selects a DC power input from the battery or an AC power input from the cord reel.

7. The vacuum cleaner set according to claim 6, wherein the control unit includes a power detecting circuit that detects if the input power is the AC or DC power using a voltage difference between the AC power and the DC power.

8. A vacuum cleaner set comprising:

a vacuum cleaner comprising:

a main body having a motor and not having a cord reel; and a coupling surface that is formed on the main body; and a cleaner mount comprising:

the cord reel;

a power cord that winds in and out in a first direction of the cord reel and is connected to an external power source;

a connection cord that winds in and out in a second direction of the cord reel and is connected to the main body of the vacuum cleaner;

a mounting portion that is configured to detachably support the main body of the vacuum cleaner, the mounting portion being formed on an upper portion of the cleaner mount; and a case that houses the cord reel and supports the mounting portion, wherein the mounting portion comprises a rounded surface; and wherein the main body is seated on the rounded surface and is erected on the cleaner mount in a state where the connection cord is connected to the main body.

* * * * *